US005907736A

United States Patent [19]

Matsumoto et al.

[11] Patent Number: 5,907,736

[45] Date of Patent: May 25, 1999

[54] PHOTOSENSITIVE MATERIAL PROCESSING APPARATUS

[75] Inventors: Nobuo Matsumoto; Fumio Mogi, both of Kanagawa, Japan

[73] Assignee: Fuji Photo Film Co., Ltd., Kanagawa, Japan

[21] Appl. No.: 08/959,318

[22] Filed: Oct. 28, 1997

[30] Foreign Application Priority Data

Oct. 28, 1996 [JP] Japan ..... 8-285634
Oct. 28, 1996 [JP] Japan ..... 8-285635

[51] Int. Cl.[6] ..... G03D 3/02

[52] U.S. Cl. ..... 396/626; 396/636

[58] Field of Search ..... 396/626, 636, 396/641; 430/30, 398–400

[56] References Cited

U.S. PATENT DOCUMENTS

| | | | |
|---|---|---|---|
| 4,954,838 | 9/1990 | Nakamura et al. | 396/636 |
| 5,432,583 | 7/1995 | Ishikawa et al. | 396/626 |
| 5,723,266 | 3/1998 | Morimoto | 430/398 |
| 5,753,424 | 5/1998 | Ishikawa | 430/398 |

FOREIGN PATENT DOCUMENTS

| | | |
|---|---|---|
| 53-34734 | 9/1978 | Japan . |
| 61-258245 | 11/1987 | Japan . |
| 63-216050 | 9/1988 | Japan . |
| 1-114847 | 5/1989 | Japan . |
| 1-310351 | 12/1989 | Japan . |
| 6-83014 | 3/1994 | Japan . |
| 6-347961 | 12/1994 | Japan . |
| 7-120900 | 5/1995 | Japan . |

*Primary Examiner*—D. Rutledge
*Attorney, Agent, or Firm*—Sughrue, Mion, Zinn, Macpeak & Seas, PLLC

[57] ABSTRACT

A feed rack in which a substantially U-shaped film passage is formed, and disposed in a processing tank such that the processing solution level of the processing tank is located below the top surface of a block by a predetermined dimension so as to reduce the area of contact between the processing solution and outside air. The processing tank is equipped with a solution level regulation tank or replenisher tank in which air-isolating member is floated on a contained solution. Between the replenisher tank and the processing tank are provided a transport mechanism for transporting a replenisher from the replenisher tank to the processing tank and a prevention mechanism for preventing the air-isolating member from entering the processing tank.

18 Claims, 12 Drawing Sheets

PHOTOSENSITIVE MATERIAL PROCESSING APPARATUS

BACKGROUND OF THE INVENTION

1. Field of the Invention

The present invention relates to a photosensitive material processing apparatus for processing a photosensitive material by immersing the photosensitive material in a processing solution contained in a processing tank. More particularly, the invention relates to a photosensitive material processing apparatus for processing a photosensitive material in a small amount of processing solution which is contained in a processing tank such that the surface area of the processing solution in the processing tank is small, and to a photosensitive material processing apparatus equipped with a replenisher tank for accommodating a replenisher for replenishing the replenisher into the processing tank.

2. Description of the Related Art

In a photosensitive material processing apparatus for developing a photosensitive material such as photographic film, the photosensitive material is processed by immersing in a processing solution contained in a processing tank. The processing tank is replenished with a replenisher (the processing solution) which is fed from a replenisher tank on the basis of deterioration of the processing solution contained in the processing tank or the lowering of the level of the processing solution in the processing tank.

Since certain processing solutions deteriorate (oxidation) when the processing solutions and air come into contact in order to reduce the deterioration of a processing solution, there have recently been proposed photosensitive material processing apparatuses in which the surface area of the processing solution is small and a photosensitive material is processed in a small amount of a processing solution contained in a processing tank, and photosensitive material processing apparatuses in which floating members are floated on the surface of the processing solution, as described in, for example, Japanese Patent Application Publication (JP-B) No. 53-34734 and Japanese Patent Application Laid-Open (JP-A) Nos. 61-258245, 63-216050, 1-114847, 1-310351, 6-83014, 6-347961, and 7-120900.

According to JP-A No. 63-216050, the cross-sectional area of a processing passage is made small so that a photosensitive material can be washed efficiently by use of a small amount of washing water. However, since the surface area of a processing solution contained in the processing passage becomes small, the height of the processing solution in the processing tank varies greatly with the amount of the processing solution. Variation in the level of the processing solution results in variation in the processing time during which a photosensitive material is immersed in the processing solution, so that a problem that the photosensitive material cannot properly be processed arises.

According to JP-A No. 1-114847, the cross-sectional area of a processing tank is made small, so that a processing solution level varies greatly with variation in the amount of a processing solution contained in the processing tank.

According to JP-A No. 1-310351, a fluid is floated on the surface of a processing solution contained in a processing tank to cover the surface of the processing solution with a fluid layer, and openings are formed in the fluid layer so as to form an inlet and an outlet for feeding a photosensitive material into the processing solution and for taking out therefrom through the openings of the fluid layer. However, no measure is employed against variation in a processing solution level. Also, in this system, when a rack is removed from the processing tank, for example, for maintenance, the fluid adheres to the rack. Thus, when processing is resumed after the rack is replaced, the fluid adhering to the rack transports onto a photosensitive material. No measure is employed against this problem.

According to JP-A No. 6-83014, a processing solution is circulated through a small space defined between the wall of a tank and a rack to process a photosensitive material. Accordingly, the photosensitive material can be processed in a small amount of the processing solution. Mention is made of increasing the surface area of the processing solution in the vicinity of the processing solution where the surface contacts air. However, no measure is employed to isolate the processing solution from the ambient air.

JP-A No. 6-347961 relates to a fluid floated on the surface of a developing replenisher to cover the surface of the developing replenisher with the fluid layer. However, no measure is employed to isolate a developer in a processing tank from the ambient air. No measure is employed against variation of a developer level.

JP-A No. 7-120900 relates to a fluid floated on the surface of a bleach-fix replenisher to cover the surface of the bleach-fix replenisher with the fluid layer. However, no measure is employed to isolate a bleach-fix solution in a processing tank from the ambient air. No measure is employed against variation of the level of the bleach-fix solution.

JP-B No. 53-34734 relates to spherical members floated on the surface of a processing solution to prevent oxidation of the processing solution.

JP-A No. 61-258245 relates to a floating member floated on the surface of a processing solution while being maintained a certain posture of the member.

It is apparent that deterioration of a replenisher in a photosensitive material processing apparatus can be effectively prevented through isolation of the surface of the replenisher from the air. From the viewpoint of the preservation of a replenisher, the methods disclosed in JP-A Nos. 6-347961 and 7-120900 are ideal, in contrast with the former methods wherein a number of solid members are floated on the surface of a processing solution in order to reduce the contact area between the processing solution and the air, since the contact area can be rendered almost zero. However, problems still remain in methods for merely covering the surface of a processing solution with a floating fluid, such that when the amount of a replenisher decreases, the floating fluid together with the replenisher, is drawn into a replenishing pump. As a result, the floating fluid enters a processing tank and consequently adheres to the processing tank, racks, a photosensitive material, and the like. Since removal of the adhered fluid from the processing tank and racks is laborious work, the aforementioned methods of isolating a processing solution from the air were not put into practical use.

Also, a photosensitive material to which the floating fluid adheres undergoes uniformly processing such as development, bleach-fix, washing, and the like. Further, stains were formed on the photosensitive material due to the adhered fluid itself.

In order to avoid such problems, it has been suggested that a solution level sensor be installed in a replenisher tank so that replenishment can be stopped when the solution surface drops to a certain level, to thereby prevent the floating fluid from being drawn into the replenishing pump and to generate a signal to warn an operator to supply replenisher into the replenisher tank. However, even in this method, if the solution level sensor malfunctions, the floating fluid flows into the processing tank. Thus, this method also was not put into practical use.

SUMMARY OF THE INVENTION

A first object of the present invention is to provide a photosensitive material processing apparatus capable of preventing the deterioration of a processing solution and variation of the surface level of a processing solution.

A second object of the present invention is to provide a photosensitive material processing apparatus in which an air-isolating member is floated on a replenisher contained in a replenisher tank to isolate the replenisher surface from air in order to prevent deterioration of the replenisher, and which can prevent the air-isolating member from flowing into a processing tank.

The first object can be achieved by a photosensitive material processing apparatus comprising a processing tank for processing a photosensitive material by immersing the photosensitive material in a processing solution contained therein, a solution level regulation tank in which the solution surface of the processing solution therein is separated from the solution level of the processing tank, and a communication section through which the processing solution communicates between the processing tank and the solution level regulation tank, wherein an air-isolating member is floated on the processing solution contained in the solution level regulation tank to isolate the processing solution therein from air.

The second object can be achieved by a photosensitive material processing apparatus comprising a processing tank for processing a photosensitive material by immersing the photosensitive material in a processing solution contained therein, a replenisher tank which contains a replenisher for replenishing the replenisher into the processing tank and an air-isolating member floating on the replenisher for isolating the replenisher from ambient air, a transport mechanism for transporting the replenisher from the replenisher tank to the processing tank, and a prevention mechanism provided between the replenisher tank and the processing tank for preventing the entry of the air-isolating member into the processing tank.

DESCRIPTION OF THE PREFERRED EMBODIMENTS

Figure 1:
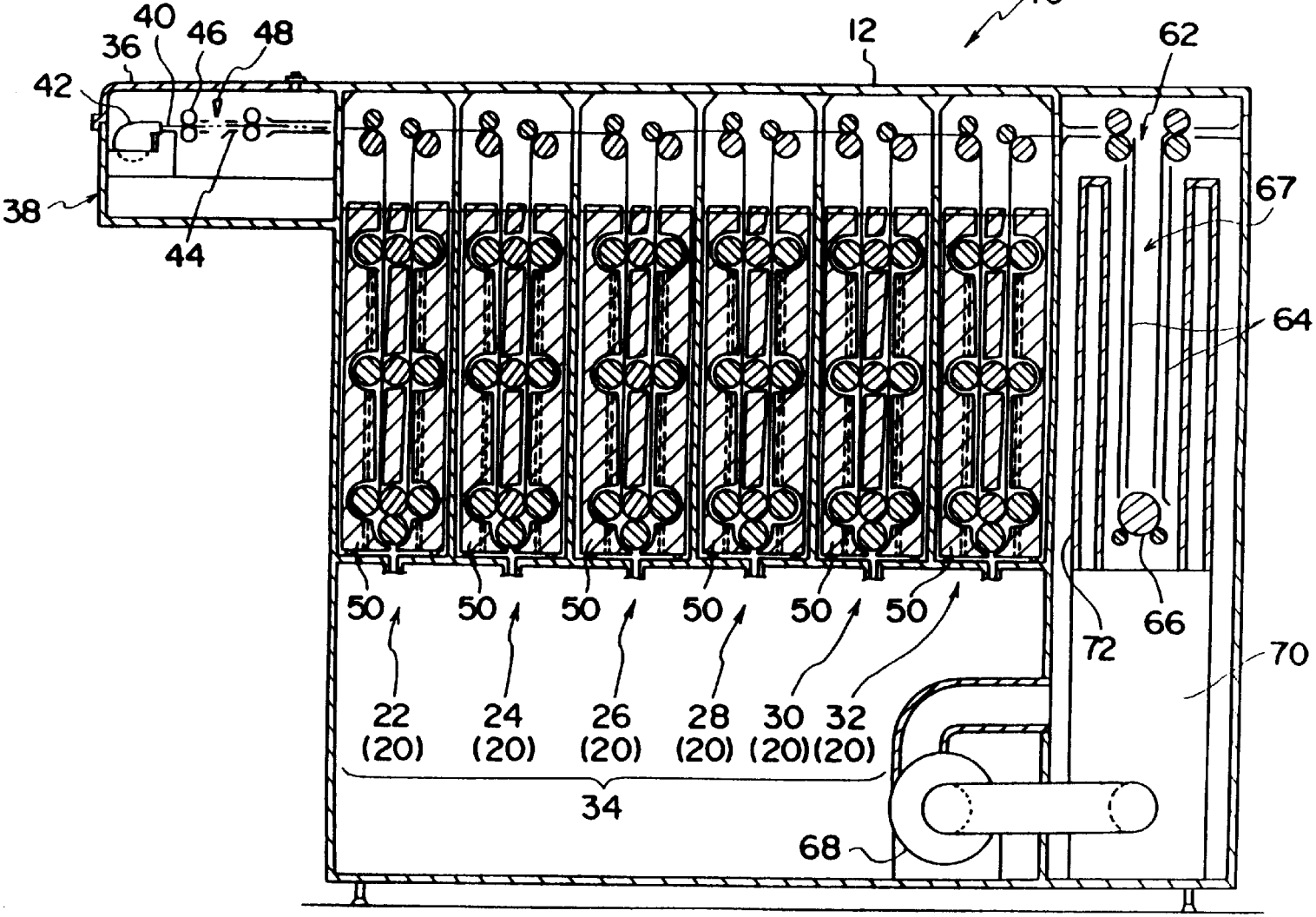
FIG. 1 is a schematic view showing the structure of a photosensitive material processing apparatus according to a first example of the present invention.

According to a first aspect of the present invention, a photosensitive material processing apparatus includes a processing tank for processing a photosensitive material by immersing the photosensitive material in a processing solution contained therein, a solution level regulation tank in which solution surface of the processing solution therein is separated from the solution level of the processing tank, and a communication section through which the processing solution communicates between the processing tank and the solution level regulation tank, wherein an air-isolating member is floated on the processing solution contained in the solution level regulation tank to isolate the processing solution therein from air.

In this photosensitive material processing apparatus, the solution level regulation tank is connected, via the communication section, to the processing tank such that the solution surface of the solution level regulation tank is separated from the solution surface of the processing tank, to minimize variation in a solution level associated with variation in the amount of the processing solution contained in the processing tank. Also, the air-isolating member is floated on the processing solution contained in the solution level regulation tank to prevent deterioration of the processing solution due to contact with air.

Preferably, the air-isolating member is a liquid having a specific gravity lower than that of the processing solution, or fine floating members. In this case, the processing solution is covered with a liquid having a lower specific gravity or with fine floating members which can be floated on the processing solution to isolate the processing solution from air.

Preferably, a filter is provided at the communication section so as to prevent passage of the air isolating member. Accordingly, the air-isolating member can be prevented from entering into the processing tank even when the level of the processing solution of the processing tank lowers.

Preferably, the communication of the processing apparatus includes a reservoir section disposed between the solution level regulation tank and the processing tank, a first solution flow passage for connecting the solution level regulation tank and the reservoir section, and a second solution flow passage provided at a higher position than that of the first solution flow passage and used for connecting the reservoir section and the processing tank. When the solution level of the processing tank drops below a certain level, the processing solution in the reservoir section is separated from that in the processing tank at the second solution flow passage to prevent the air isolating member contained in the solution level regulation tank from flowing into the reservoir section through the first solution flow passage. In this photosensitive material processing apparatus, the processing solution is contained such that a processing solution level is accommodated at a predetermined height higher than the bottom of the second solution flow passage. Thus, the processing solution communicates between the processing tank and the solution level regulation tank through the first solution flow passage and the second solution flow passage.

Accordingly, even when the solution level of the processing tank drops below a certain level, the air isolating member floating on the processing solution in the solution level regulation tank does not flow into the processing tank.

Preferably, the surface area of the processing solution contained in the solution level regulation tank is greater than that of the processing solution accommodated in the processing tank. Accordingly, variation in the solution level in the processing tank becomes small relative to the variation of the amount of the processing solution in the processing tank.

Further, preferably, the communication section has a ventilation portion open to air. As a result of contact between the processing solution in the communication section and ambient air through the ventilation portion, the surface of the processing solution of the process tank is reliably separated from that of the solution level regulation tank. Preferably, the area of the opening of the ventilation portion is as small as possible.

According to a second aspect of the present invention, a photosensitive material processing apparatus comprises a processing tank for processing a photosensitive material by immersing the photosensitive material in a processing solution contained therein, a replenisher tank which contains a replenisher to be fed into the processing tank for replenishment and also contains an air-isolating member floating on the replenisher so as to isolate the replenisher from ambient air, a transport mechanism for transporting the replenisher from the replenisher tank to the processing tank, and a prevention mechanism provided between the replenisher tank and the processing tank for preventing the entry of the air isolating member into the processing tank.

In this photosensitive material processing apparatus, the air isolating member is floated on the replenisher in the replenisher tank to cover the replenisher surface, so that deterioration of the replenisher due to contact with air can be prevented. Also, if the transport mechanism continues its operation due to malfunction of the mechanism, the prevention mechanism can prevent the air isolating member from entering the processing tank. The prevention mechanism is preferably provided between the replenisher tank and the transport mechanism.

Preferably, the prevention mechanism includes a reservoir section provided between the replenisher tank and the transport mechanism, a first solution flow passage for connecting the replenisher tank and the reservoir section, and a second solution flow passage, one end of which is connected to the reservoir section and the other end is connected to the transport mechanism. When the solution level of the reservoir section lowers to the bottom end of the opening of the second solution flow passage at the one end thereof, the air-isolating member in the replenisher tank does not flow into the reservoir section through the first solution flow passage.

Accordingly, even when the transport mechanism continues its operation, and the surface of the solution of the reservoir section reaches to the bottom end of the opening of the second solution flow passage at the one end thereof, the replenisher in the reservoir section cannot be drawn into the transport mechanism. Thus, the air-isolating member in the replenisher tank does not flow toward the transport mechanism.

Preferably, the prevention mechanism is a filter which allows the replenisher to pass therethrough, but does not allow the air-isolating member to pass therethrough. Therefore, the air-isolating member does not flow into the processing tank in any event. The filter is provided preferably between the replenisher tank and the transport mechanism.

This photosensitive material processing apparatus further includes a replenisher charging section for charging a replenisher into the replenisher tank therethrough. The replenisher outlet of the replenisher charging section is positioned lower than the minimum level of the air-isolating member floating on the replenisher in the replenisher tank. Accordingly, since the replenisher outlet is positioned lower than the minimum level of the air-isolating member while the replenisher is being charged into the replenisher tank, the replenisher does not splash over the air-isolating member, thereby preventing the air-isolating member from submerging under the surface of the replenisher.

Accordingly, when a filter is used as the prevention mechanism, the air-isolating member does not adhere to the filter during normal operation. Also, the air-isolating member does not flow out from the replenisher tank through the first solution flow passage while the replenisher tank is being fed with the replenisher when the prevention mechanism includes a first reservoir section provided between the replenisher tank and the transport mechanism, a first solution flow passage for connecting the replenisher tank and the reservoir section, a second reservoir section provided between the first reservoir section and the transport mechanism, and a second solution flow passage located higher than the first solution flow passage and used for connecting the first reservoir section and the second reservoir section, and functions such that when the replenisher level of the second reservoir section drops below a certain level, the replenisher in the first reservoir section is separated at the second solution flow passage from that in the second reservoir section to thereby prevent the air-isolating member in the replenisher tank from flowing into the first reservoir section through the first solution flow passage.

Preferably, the air-isolating member is a liquid having a lighter specific gravity than that of the replenisher, or fine floating members. The replenisher is covered with a liquid having a specific gravity light enough to float on the replenisher or with fine floating members, to thereby isolate the replenisher from outside air.

EMBODIMENTS

First Embodiment

FIG. 1 shows an automatic processor 10 serving as a photosensitive material processing apparatus used in the present invention. The automatic processor 10 includes a plurality of processing tanks 20 which are surrounded by a frame 12 to block out the light. The processing tanks 20, from left to right in FIG. 1, serve as a developing tank 22 for containing a developer, a bleaching tank 24 for containing a bleaching solution, a fixing tank 26 for containing a fixing solution, wash tanks 28 and 30 for containing washing water, and a stabilizing tank 32 for containing a stabilizer, thereby constituting a processing section 34.

The automatic processor 10 includes a film loading section 38 which protrudes from the frame 12 toward the left side of the processing section 34 as viewed in FIG. 1 and which is light-shielded with a cover 36, which is to be opened for loading the film loading section 38 with film. A cartridge 42 which contains an exposed photographic film (hereinafter referred to as a negative film 40) wound in a rolled form therein is loaded to the film loading section.

The film loading section 38 is equipped with guide plates 44 which are situated above and below the transport path of the film, a plurality of feed rollers 46, and a cutter 48. The negative film 40 is nipped and held between the plurality of feed roller 46 and drawn out from the cartridge 42 and is fed to the processing section 34. The cutter 48 cuts the rear end portion of the negative film 40 at a predetermined position to thereby separate the negative film 40 from the cartridge 42.

A feed rack 50 is disposed in each of the processing tanks 20 of the processing section 34.

Figure 2:
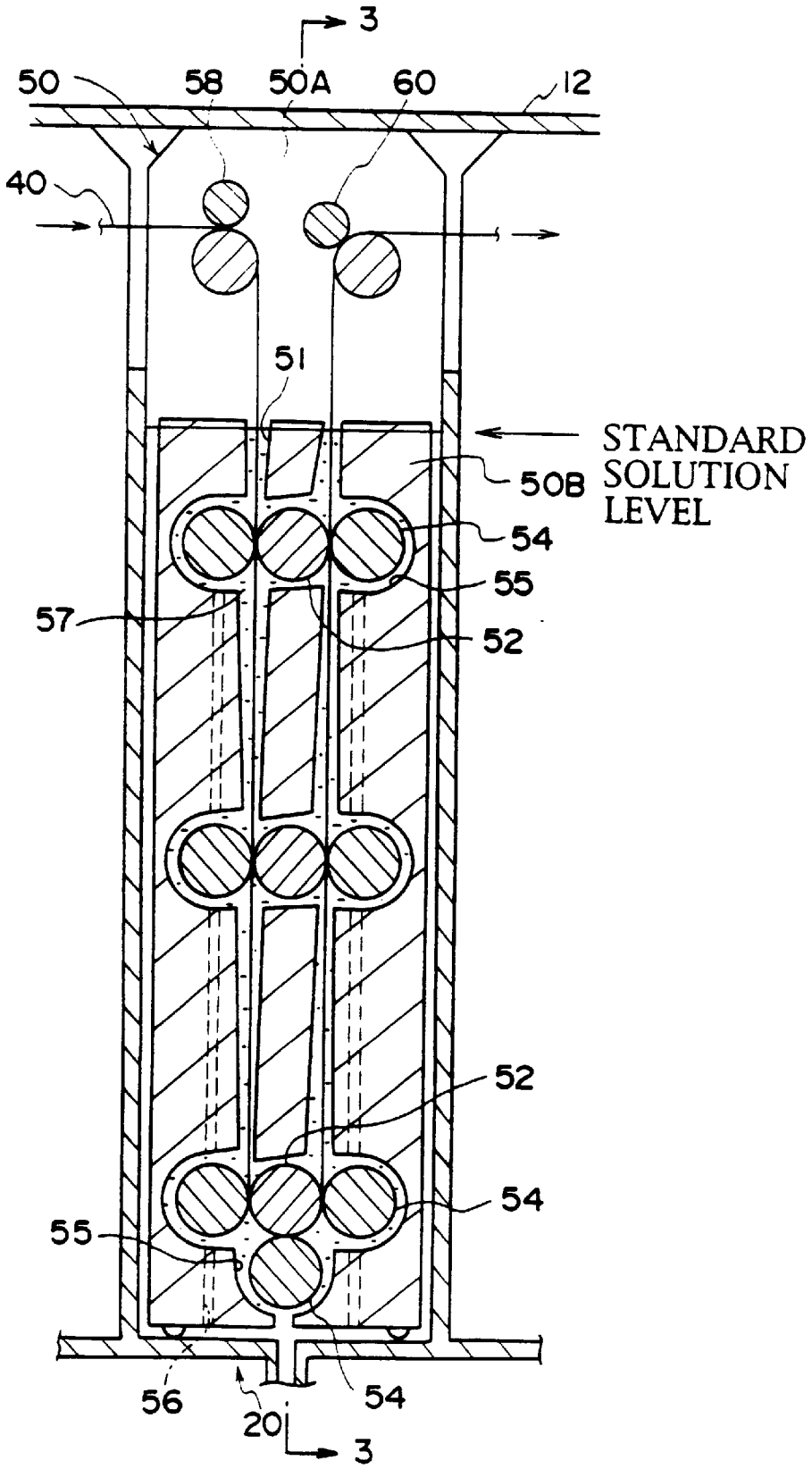
FIG. 2 is an enlarged view showing a processing tank.
Figure 3:
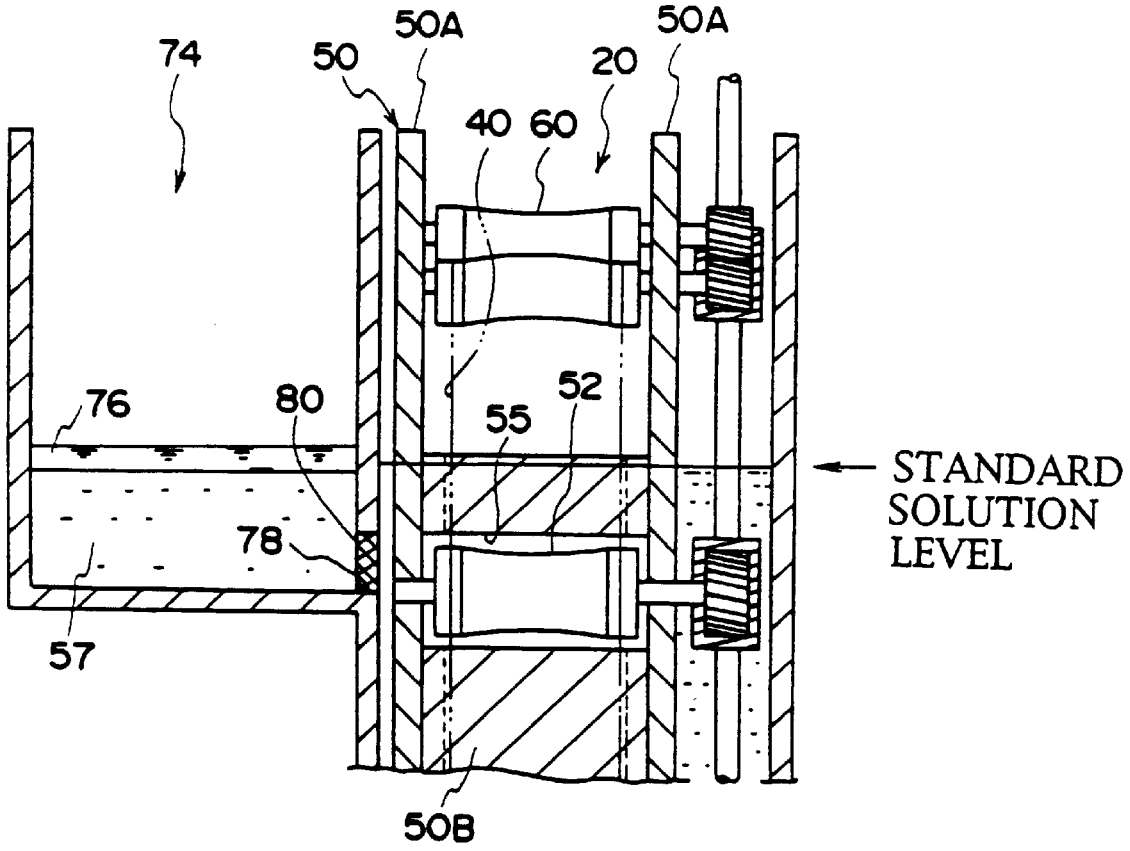
FIG. 3 is a sectional view taken along the line 3—3 of FIG. 2.

As shown in FIGS. 2 and 3, the feed rack 50 includes a pair of side panels 50A arranged in parallel to each other and a block 50B which is disposed between the side panels 50A and in which a substantially U-shaped film passage 51 is formed.

A plurality of rollers 52 are arranged in the block 50B along the vertical centerline of the block 50B. A roller 54 is provided on both sides of each roller 52 and under the bottom roller 52 so that the negative film 40 can be held between the rollers 52 and 54 to thereby be transported. A recess 55 is formed in the block 50B in order to accommodate the rollers 52 and 54. Also, an air vent 56 is formed in the block 50B so as to connect the recesses 55 in a vertical direction.

The standard solution level determined for the processing tank 20 is located by a predetermined dimension below the top surface of the block 50B. Accordingly, in the processing tank 20, the solution surface is exposed to outside air only in the film passage 51 and between the feed rack 50 and the inner wall surface of the processing tank 20, thereby rendering the contact area between a processing solution 57 and outside air small.

The negative film 40 fed into the processing tank 20 is guided and fed in a substantially U-shaped form by the feed rack 50 to thereby be immersed in the processing solution 57. Above the blocks 50B are provided guide rollers 58 for drawing in the negative film 40 fed from the film loading section 38 or an upstream processing tank 20, and guide rollers 60 for feeding out the negative film 40 into a downstream processing tank 20.

As shown in FIG. 1, a drying section 62 is provided on the right-hand side of the processing section 34. The drying section 62 includes a drying rack 67 equipped with guides 64, a turn roller section 66, and the like. The drying section 62 is equipped with a drying fan 68 and an unillustrated heater for generating a drying wind. The drying fan 68 sends air from the drying section 62 to a chamber 72, as a drying wind, through a drying duct 70.

Accordingly, the negative film 40 fed into the drying section 62 is dried by the drying wind discharged from the chamber 72 while being guided and fed by the drying rack 67. The dried negative film 40 is then discharged from the automatic processor 10.

As shown in FIG. 3, a solution level regulation tank 74 having a constant horizontal sectional area is provided on one side of the processing tank 20. The solution level regulation tank 74 contains the processing solution 57 and air-isolating member 76 having a smaller specific gravity than that of the processing solution 57. The horizontal sectional area, i.e. the area of the solution surface, of the solution level regulation tank 74 is set greater than the area of the solution surface of the processing tank 20.

In the present embodiment, liquid paraffin is used as the air-isolating member 76. The air-isolating member 76 may be any liquid other than liquid paraffin (e.g. liquid saturated hydrocarbon) or fine floating members (e.g. MICRO BALLOON FILITE MANUFACTURED BY NIPPON FILITE CO. LTD.) so long as such products do not evaporate at room temperature or react with the processing solution 57 or do not mutually dissolve with the processing solution 57.

The air-isolating member 76 is contained in such an amount as to cover the entire surface of the processing solution 57 contained in the solution level regulation tank 74 in order to prevent the processing solution 57 from coming into contact with outside air.

The processing tank 20 and the solution level regulation tank 74 are connected through a passage 78 serving as a communication section. The passage 78 is located at a predetermined dimension below the predetermined standard level of the processing solution 57 in the processing tank 20, and allows the processing solution 57 to flow between the processing tank 20 and the solution level regulation tank 74.

Figure 4:
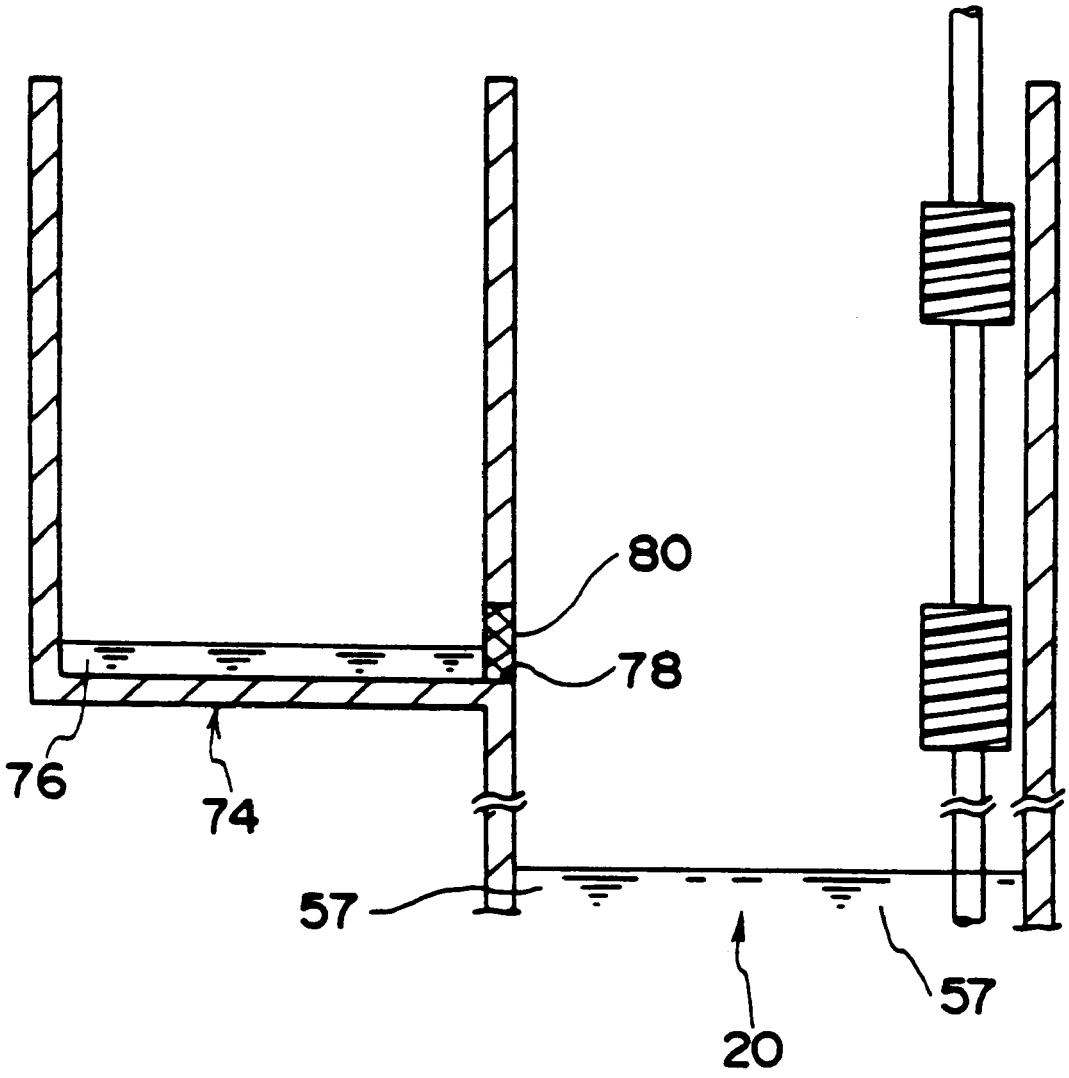
FIG. 4 is a sectional view showing the processing tank of FIG. 3 after a conveying rack is removed.

A filter 80 which allows passage of the processing solution 57, but prevents passage of the air-isolating member 76, is attached to the passage 78. As shown in FIG. 4, even when the solution level of the processing tank 20 drops greatly as a result of the removal of the feed rack 50, the air-isolating member 76 does not flow into the processing tank 20.

Examples of the filter 80, which prevents passage of liquid paraffin, but allows passage of the processing solution 57, may include TOUGHNEL OIL BLOTTER manufactured by Mitsui Petrochemical Industries, Ltd. This product adsorbs oil, but does not adsorb water. When fine floating members are used as the air-isolating member 76, meshes, woven fabrics, unwoven fabrics, and the like may be used as the filter 80 so long as they have many pores smaller than the floating members.

The operation of the present embodiment will now be described.

In the automatic processor 10, a negative film 40 is drawn out from a cartridge 42 loaded in the film loading section 38 and is then fed into the processing section 34. In the processing section 34, the negative film 40 is guided and fed by the feed racks 50 provided in the respective processing tanks 20 to thereby undergo development, bleaching, fixing, washing, and stabilization through immersion in a developer, a bleaching solution, a fixing solution, washing water, and a stabilizer, respectively.

After having been processed in the processing section 34, the negative film 40 is fed into the drying section 62. In the drying section 62, the negative film 40 is guided and fed by the drying rack 67 to thereby undergo drying through exposure to a drying wind which is generated by the drying fan 68 and an unillustrated heater and discharged from the chamber 72. The thus-dried negative film 40 is discharged from the automatic processor 10.

In each of the processing tanks 20, the amount of the contained processing solution 57 varies with an amount of processing solution carried over with negative film 40, evaporation, variations in replenishment, and the like. In the present embodiment, however, since the solution level regulation tank 74 having a relatively large solution surface area is connected to the corresponding processing tank 20, variation in a solution level associated with variation in the amount of the contained processing solution 57 becomes smaller when compared to the processing tank 20 not equipped with the solution level regulation tank 74. As the solution surface area of the solution level regulation tank 74 increases, variation in solution level associated with variation in the amount of the contained processing solution 57 becomes smaller.

That is, variation in the length of the pass along which the negative film 40 is fed becomes smaller. In other words, variation in processing time (immersion time) of the negative film 40 becomes smaller, so that the negative film 40 can be stably processed all the time.

In the present embodiment, the surface area of the processing solution 57 contained in the solution level regulation tank 74 is rendered large in order to reduce variation in solution level associated with reduction in the amount of the processing solution 57. Even so, since the air-isolating member 76 prevents contact between the solution surface and outside air, deterioration of the processing solution 57, due to contact with the air, can be inhibited.

As shown in FIG. 4, when the feed rack 50 is removed from the processing tank 20 for maintenance, the level of the processing solution 57 of the processing tank 20 drops significantly, so that the processing solution 57 flows out from the solution level regulation tank 74 into the processing tank 20 through the passage 78. However, since the filter 80 prevents passage of the air-isolating member 76, the air-isolating member 76 does not adhere to the feed rack 50 and the processing tank 20.

Second Embodiment

A second embodiment of the present invention will be described with reference to FIGS. 5 and 6. The same features as those of the first example are denoted by common reference numerals, and their description is omitted.

Figure 5:
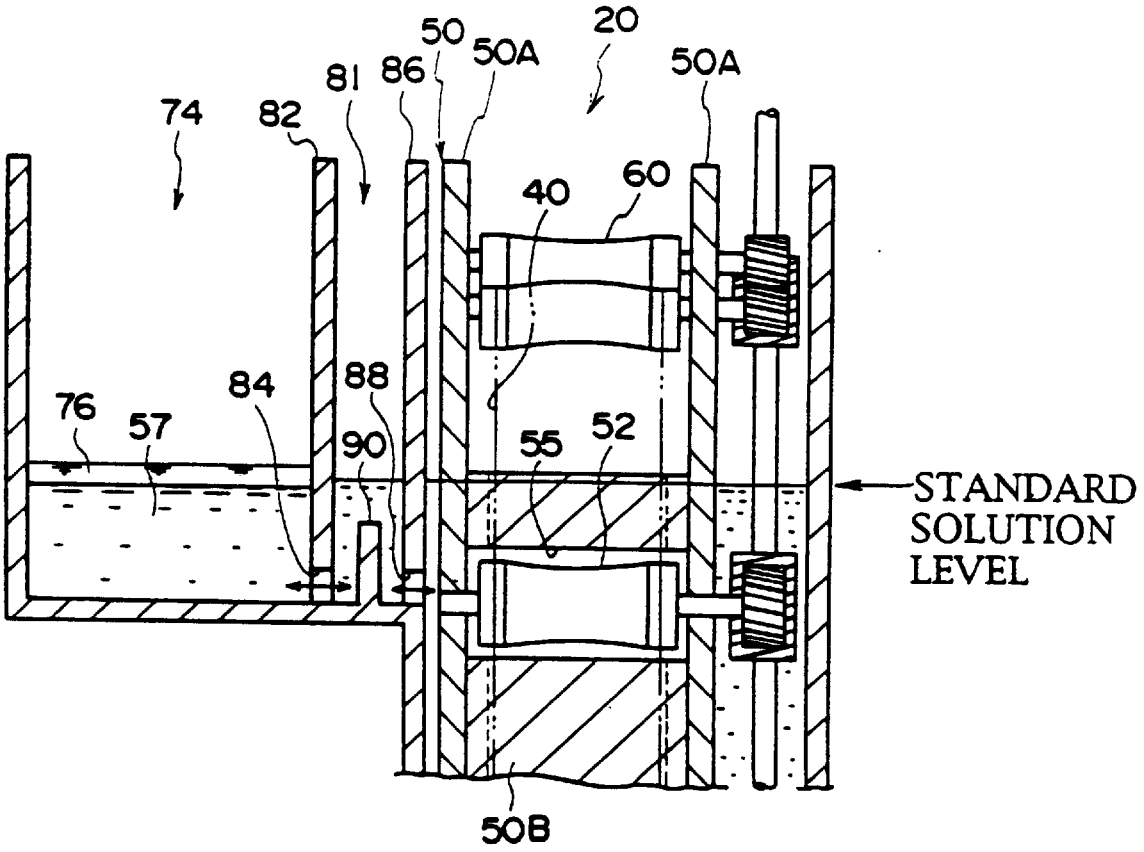
FIG. 5 is a sectional view showing a processing tank of a photosensitive material processing apparatus according to a second example of the present invention.

As shown in FIG. 5, a reservoir section 81 which has an open top section is provided between the processing tank 20 and the solution level regulation tank 74. An opening 84 serving as a first solution flow passage is formed in a partition wall 82, which separates the reservoir section 81 from the solution level regulation tank 74, in the vicinity of the bottom of the solution level regulation tank 74. An opening 88 is formed in the partition wall 86, which separates the reservoir section from the processing tank 20, at the same height as that of the opening 84.

A weir 90 acting as a part of second solution flow passage is provided in the reservoir section 81 between the partition walls 82 and 86. The top end of the weir 90 is positioned higher by a predetermined dimension than the top ends of the openings 84 and 88 and lower by a predetermined dimension than the predetermined standard level of the processing solution 57 of the processing tank 20. Accordingly, the processing solution 57 can flow over the weir 90 to flow between the processing tank 20 and the solution level regulation tank 74 in both directions. Therefore, also in the present embodiment, it is possible to reduce variations in a solution level associated with variations in the amount of the processing solution 57 contained in the processing tank 20.

Figure 6:
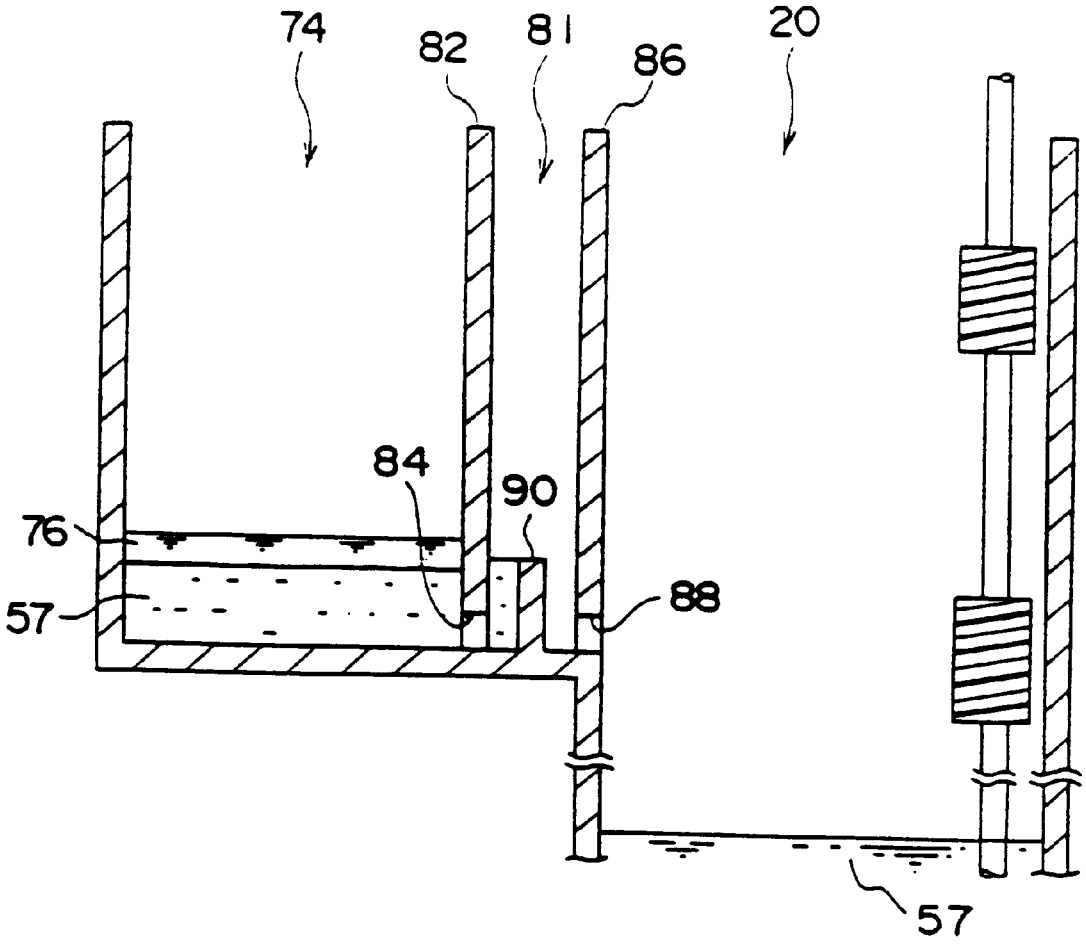
FIG. 6 is a sectional view showing the processing tank of FIG. 5 after a conveying rack is removed.

As shown in FIG. 6, even when the level of the processing solution 57 in the processing tank 20 drops, the solution level of the solution level regulation tank 74 and the reservoir section 81 does not drop below the top end of the weir 90. Accordingly, the air-isolating number 76 contained in the solution level regulation tank 74 does not flow into the processing tank 20.

The difference in height between the top end of the opening 84 and that of the weir 90 and the thickness of the air-isolating member 76 are determined such that the bottom surface of the air-isolating member 76 does not become lower than the top end of the opening 84.

If the top portion of the reservoir section 81 is closed, when the level of the processing solution 57 of the processing tank 20 drops greatly, it is considered that the air-isolating member 76 contained in the solution level regulation tank 74 flows into the processing tank 20 in the manner of a siphon. Therefore, the upper portion of the reservoir section 81 must be open to outside air.

Third Embodiment

A third embodiment of the present invention will be described with reference to FIGS. 7, 8A and 8B. The same features as those of the above-described embodiments are denoted by common reference numerals, and their description is omitted.

Figure 7:
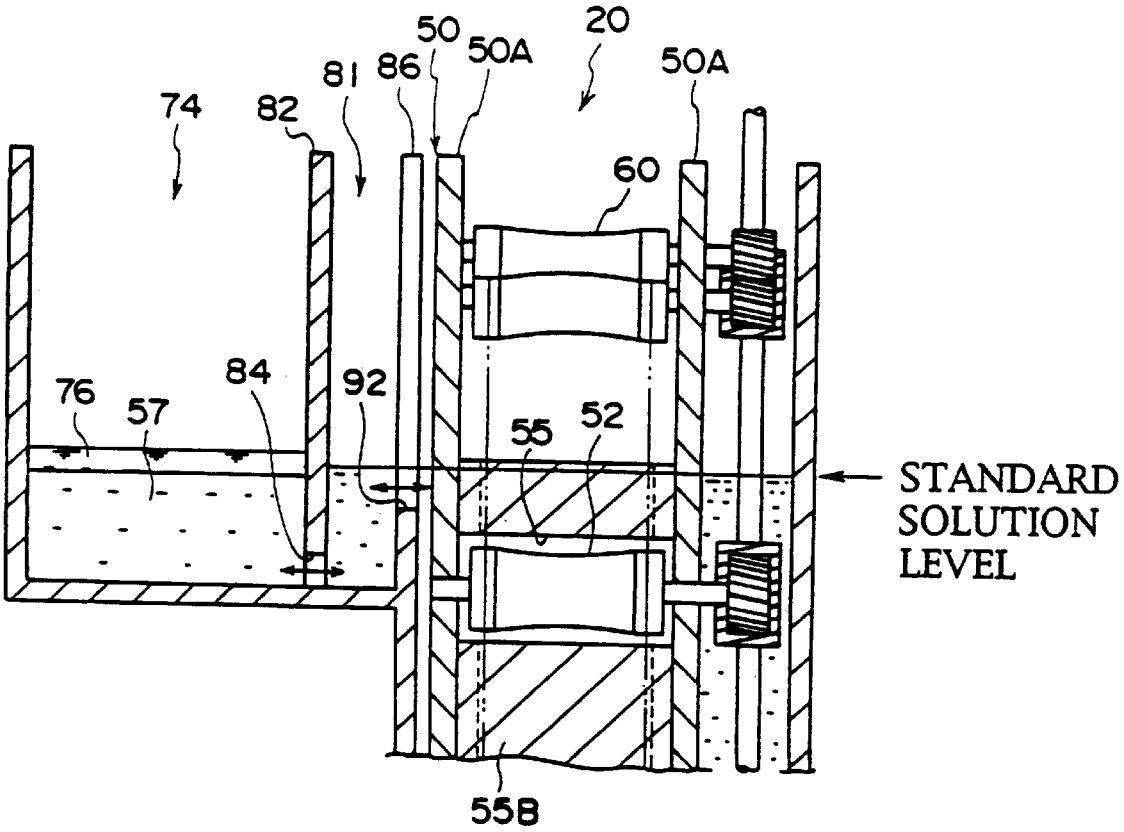
FIG. 7 is a sectional view showing a processing tank of a photosensitive material processing apparatus according to a third example of the present invention.

As shown in FIG. 7 in the present embodiment, in the partition wall 86 has a notch (or an opening) 92 which serves as a second solution flow passage, the bottom end of which is positioned lower by a predetermined dimension than the standard level of the processing solution 57 of the processing tank 20. Usually, the processing solution 57 can communicate between the processing tank 20 and the solution level regulation tank 74 through the opening 84 and the notch 92.

Figure 8A:
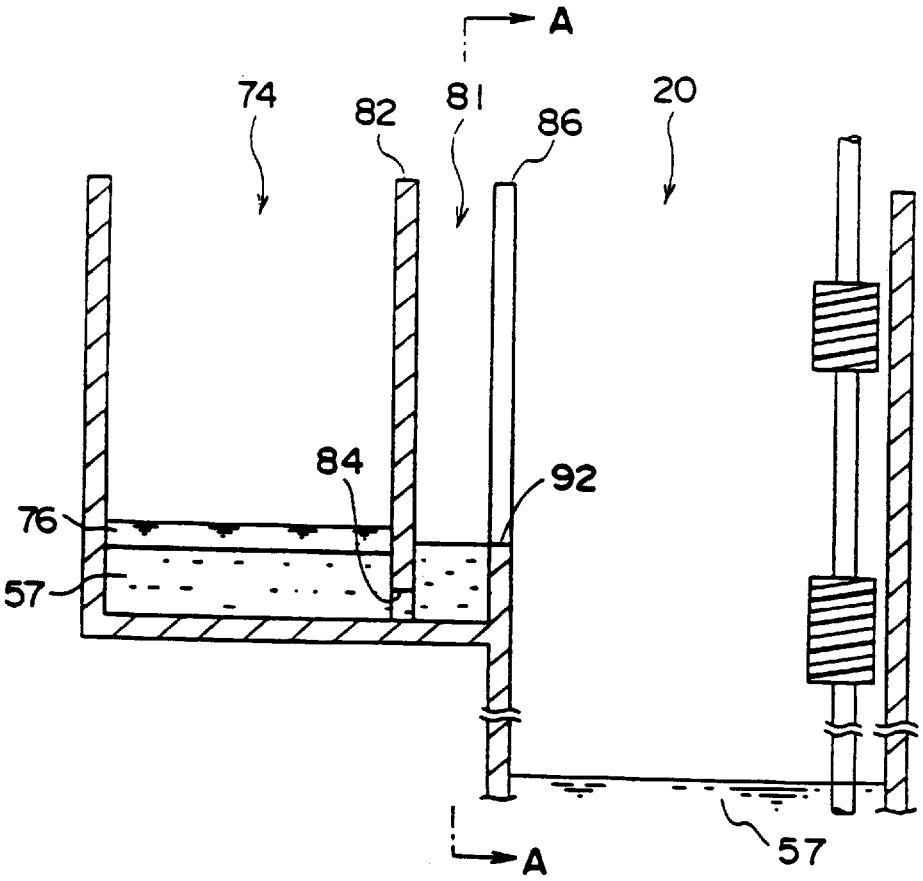
FIG. 8A is a sectional view showing the processing tank of FIG. 7 after a conveying rack is removed.
Figure 8B:
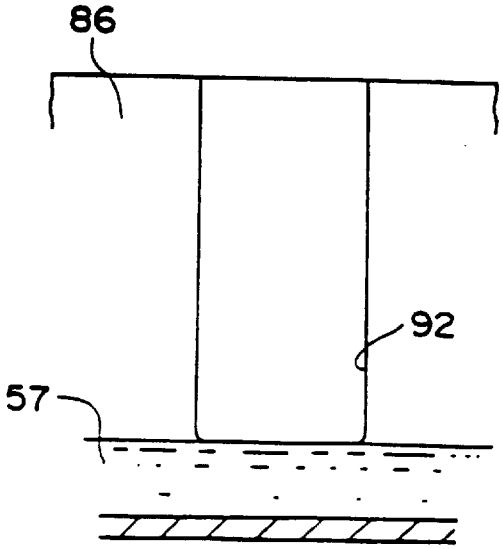
FIG. 8B is a sectional view taken along the line A—A of FIG. 8A.

As shown in FIGS. 8A and 8B, even when the level of the processing solution 57 of the processing tank 20 drops greatly, the level of the processing solution 57 in the solution level regulation tank 74 and the reservoir section 81 does not drops below the bottom end of the notch 92, so that the air-isolating member 76 in the solution level regulation tank 74 does not flow into the processing tank 20.

Fourth Embodiment

Figure 9:
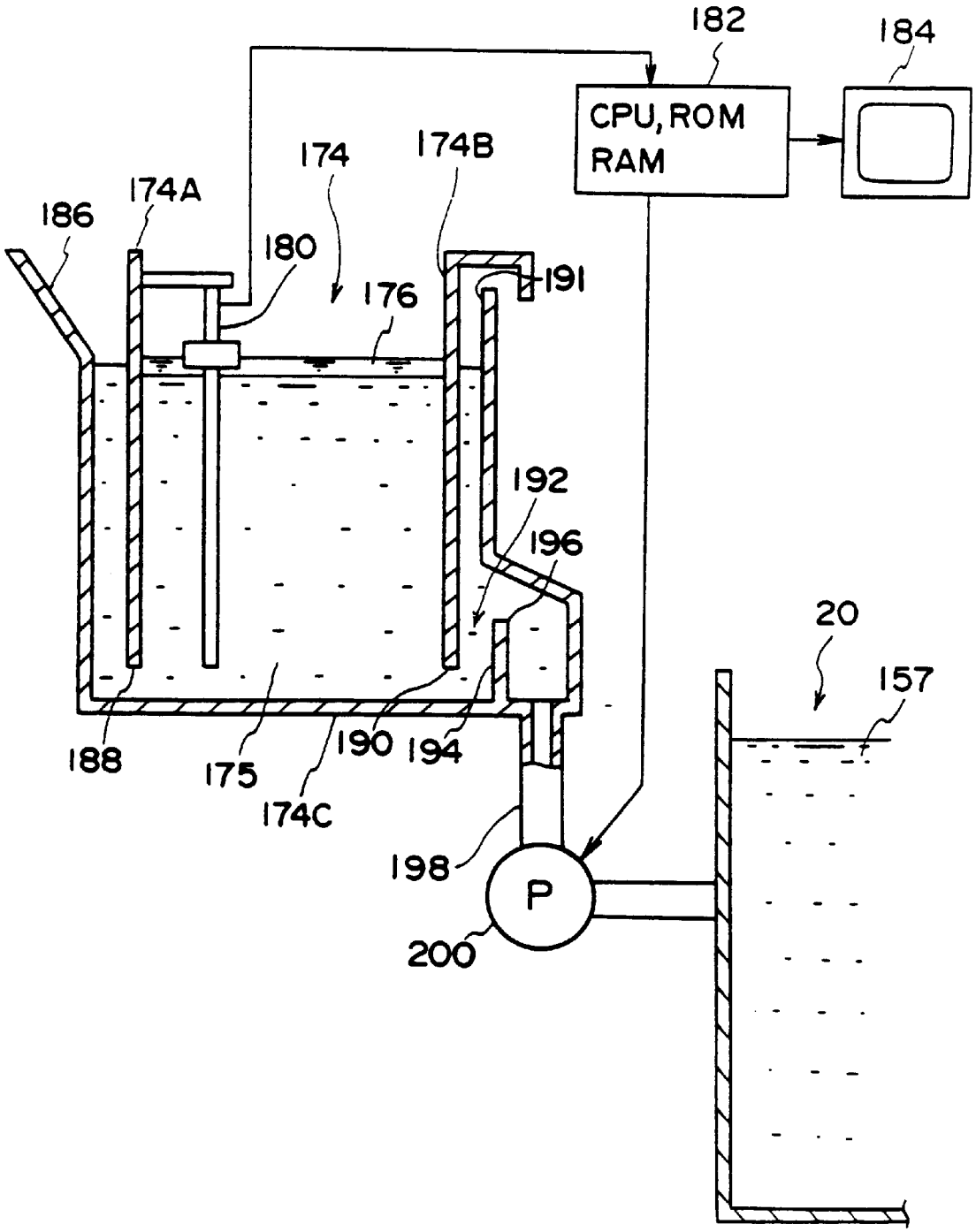
FIG. 9 is a sectional view showing the replenisher tank system of a photosensitive material processing apparatus according to a fourth example of the present invention.

The main body of the automatic processor of the present embodiment has basically the same structure as that of the automatic processor 10 shown in FIG. 1 and is also denoted by reference numeral 10. As shown in FIG. 9, the automatic processor 10 has a replenisher tank 174 corresponding to each of the processing tanks 20.

The replenisher tank 174 contains a replenisher 175 and an air-isolating member 176 whose specific gravity is less than that of the replenisher 175. In the present embodiment, liquid paraffin is used as the air-isolating member 176. The air-isolating member 176 may be any liquid (e.g. liquid saturated hydrocarbon) other than liquid paraffin or fine floating members (e.g. MICRO BALLOON (Filite manufactured by Nippon Filite Co. Ltd.)) so long as such products do not evaporate at room temperature or react with the replenisher 175 or are not mutually soluble with the replenisher 157.

The air-isolating member 176 is contained in such an amount as to cover the entire surface of the replenisher 175 contained in the replenisher tank 174 in order to prevent the replenisher 175 from coming into contact with outside air.

A float type level sensor 180 is provided in the replenisher tank 174 and is connected to a controller 182. The controller 182 monitors the amount of the replenisher 175 contained in the replenisher tank 174 by means of the level sensor 180 and causes a display unit 184 to display a message for prompting an operator to supply the replenisher tank 174 with the replenisher 175 when the level of the replenisher 175 drops to a predetermined minimum level.

The replenisher tank 174 is integrally provided with a replenisher supply section 186, which serves as a replenisher charging section, for supplying the replenisher 175 to the replenisher tank 174. The replenisher supply section 186 has substantially a funnel shape. An outlet 188, which serves as a replenisher outlet of the replenisher supply section 186 is connected to the bottom end of a side wall 174A of the replenisher tank 174.

When a message for prompting an operator to supply the replenisher 175 is displayed on the display unit 184, the operator supplies the replenisher 175 from the upper portion of the replenisher supply section 186. The supplied replenisher 175 flows into the replenisher tank 174 through the outlet 188.

An opening 190 serving as a first solution flow passage is formed at the bottom end of a side wall 174B of the replenisher tank 174. A reservoir section 192 is provided outside the side wall 174B and its upper portion is open to outside air through an air passage 191.

A wall 194 is provided in the reservoir section 192 and stands on a bottom surface 174C. An opening 196 serving as one end of a second solution passage is formed in the wall 194 such that the bottom end thereof is positioned higher than the top end of the opening 190.

The opening 190, the reservoir section 192, the wall 194, and the opening 196 constitute a prevention mechanism of the present invention.

As is seen in FIG. 9, one end of a pipe 198 serving as part of the second solution passage is connected to the bottom of the reservoir section 192 at a position opposite to the opening 190 with respect to the wall 194 and is open to the reservoir section 192. The other end of the pipe 198 is open to the processing tank 20. A pump 200 serving as part of a transport mechanism is provided at the intermediate portion of the pipe 198. The pump 200 operates under the control of the controller 182 and is caused to stop when the level of the replenisher 175 contained in the replenisher tank 174 drops to a predetermined minimum level.

Preferably, the inner diameters of the air passage 191 and the intermediate portion of the replenisher supply section 186 are rendered as small as possible in order to reduce the surface area of the replenisher 175 in the air passage 191 and the intermediate portion.

The operation of the present embodiment will now be described.

As shown in FIG. 1, in the automatic processor 10, the negative film 40 is drawn out from the cartridge 42 loaded in the film loading section 38 and is then fed into the processing section 34. In the processing section 34, the negative film 40 is guided and fed by the feed racks 50 provided in the respective processing tanks 20 to thereby undergo development, bleaching, fixing, washing, and stabilization through immersion in a developer, a bleaching solution, a fixing solution, washing water, and a stabilizer, respectively.

After having been processed in the processing section 34, the negative film 40 is fed into the drying section 62. In the drying section 62, the negative film 40 is guided and fed by the drying rack 67 to thereby undergo drying through exposure to a drying wind which is generated by the drying fan 68 and an unillustrated heater and discharged from the chamber 72. The thus-dried negative film 40 is discharged from the automatic processor 10.

Figure 10:
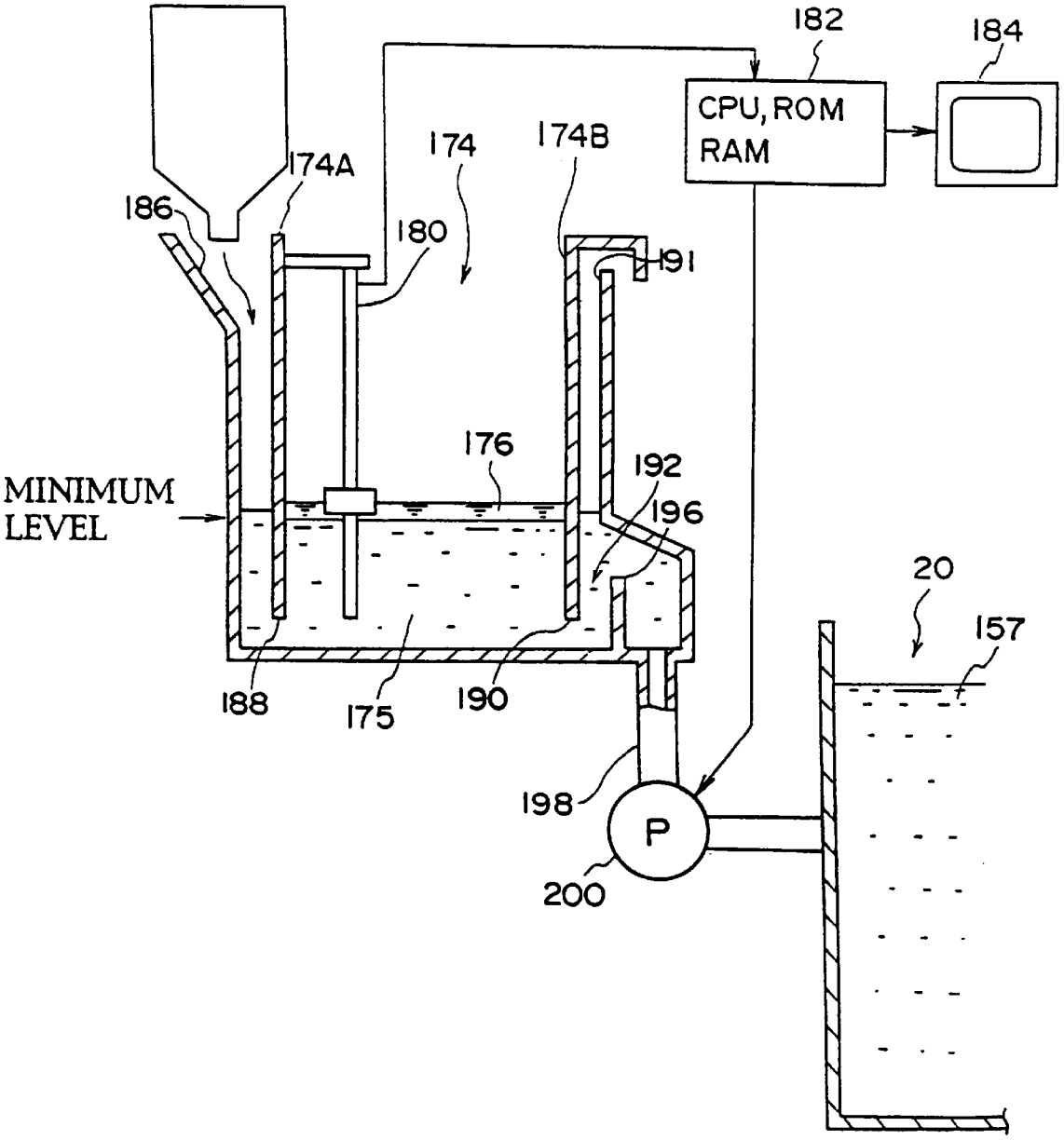
FIG. 10 is a sectional view showing the replenisher tank of the fourth example when the surface of a replenisher has reached a minimum level.

When the replenisher 175 is replenished from the replenisher tank 174 to the processing tank 20 through the operation of the pump 200, and consequently the level of the replenisher 175 of the replenisher tank 174 drops to a predetermined minimum level as shown in FIG. 10, a message for prompting the operator to supply the replenisher tank 174 with the replenisher 175 is displayed on the display unit 184. When the operator supplies the replenisher 175 from the upper portion of the replenisher supply section 186, the supplied replenisher 175 flows into the replenisher tank 174 through the outlet 188.

Figure 11:
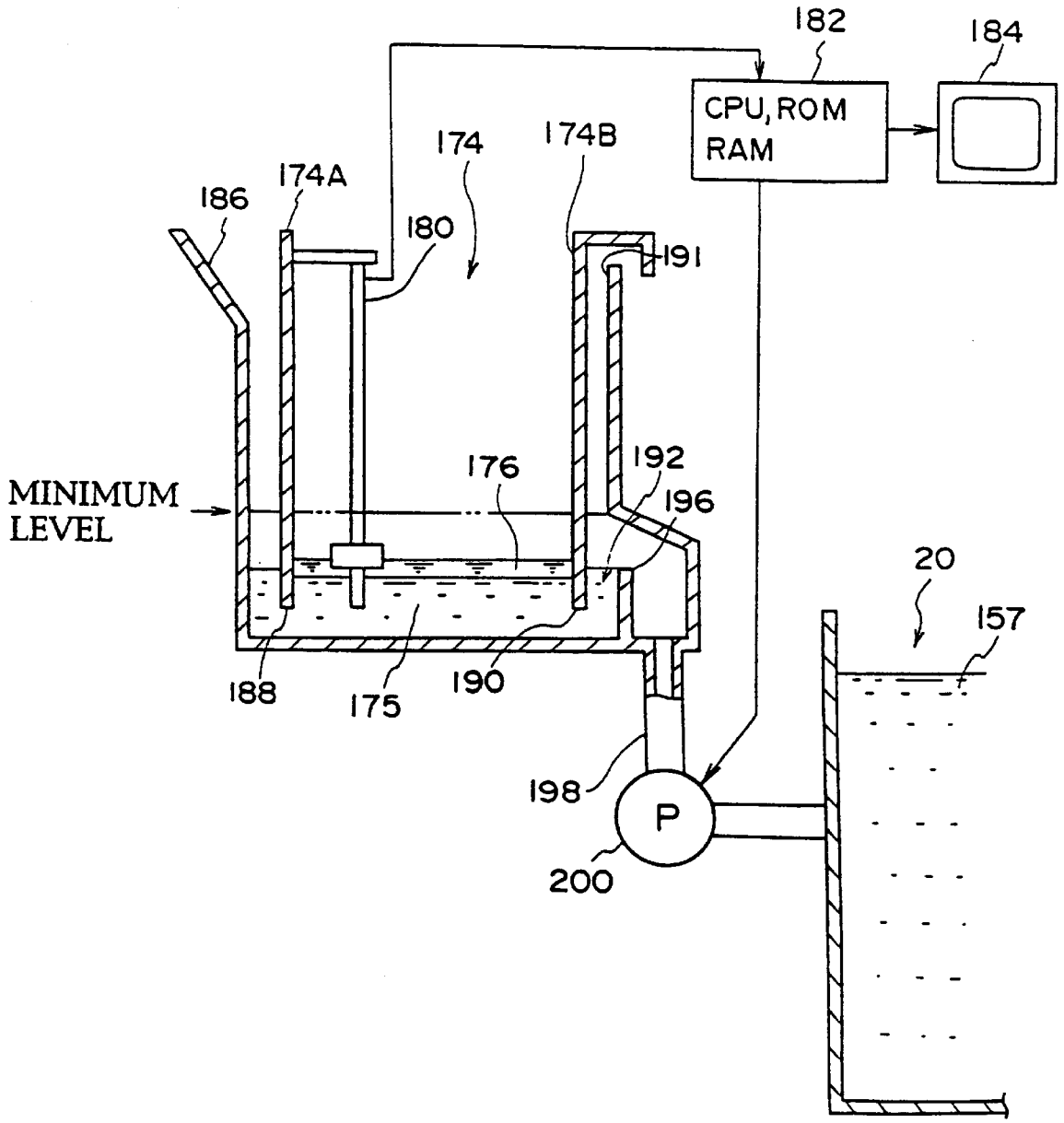
FIG. 11 is a sectional view showing the replenisher tank of the fourth example when the surface of a replenisher has lowered below the minimum level.

If the pump 200 continues its operation due to malfunction of the level sensor 180, the controller 182, or the like, the level of the replenisher 175 of the replenisher tank 174 drops below the predetermined minimum level as shown in FIG. 11. Even in such a case, the level of the replenisher 175 drops ultimately to the bottom end of the opening 196. Accordingly, the air-isolating member 176 floating on the replenisher 175 does not flow out from the replenisher tank 174 through the opening 190, since the opening 190 is located below the opening 196.

The outlet 188 of the replenisher supply section 186 is located lower than the minimum level of the air-isolating member 176. Accordingly, while the replenisher 175 is being charged into the replenisher tank 174, the air-isolating member 176 is prevented from submerging under the replenisher 175. Thus, the air-isolating member 176 does not flow into the reservoir section 192 through the opening 190.

Accordingly, in the automatic processor 10 of this embodiment, the air-isolating member 176 prevents the replenisher 175 contained in the replenisher tank 174 from being deteriorated, and is reliably prevented from flowing out from the replenisher tank 174 into the processor tank 20.

Fifth Embodiment

A fifth embodiment of the present invention will be described with reference to FIG. 12. The same features as those of the fourth embodiment are denoted by common reference numerals, and their description is omitted.

Figure 12:
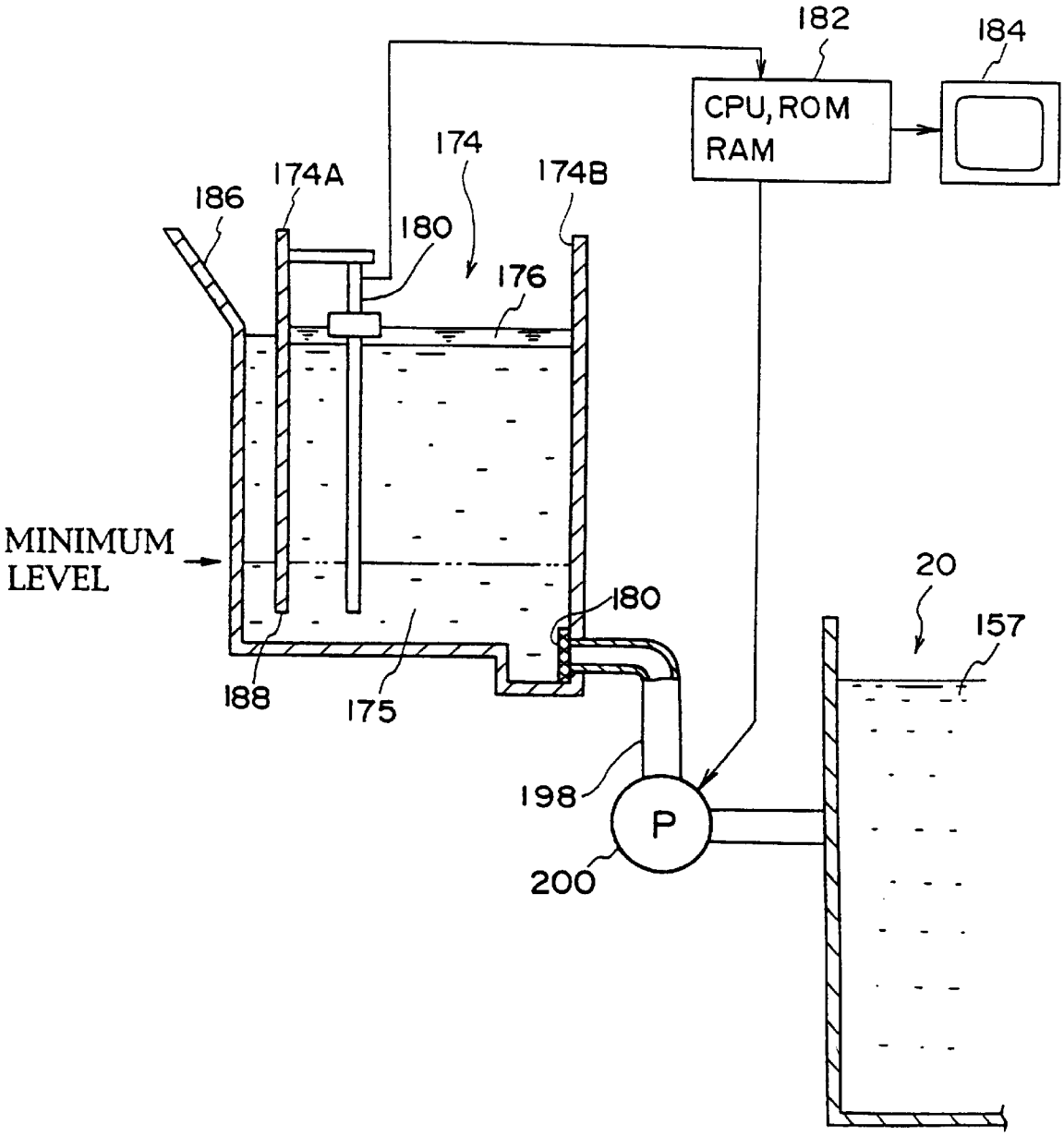
FIG. 12 is a sectional view showing the replenisher tank system of a photosensitive material processing apparatus according to a fifth example of the present invention.

As shown in FIG. 12, one end of a pipe 198 is connected to the bottom end of the side wall 174B of the replenisher tank 174. A filter 180 which allows the processing solution 157 to pass therethrough, but prevents passage of the air-isolating member 176, is attached to one end of the pipe 198.

Examples of the filter 180, which prevents passage of liquid paraffin, but allows the processing solution 157 to pass therethrough, may include TOUGHNEL OIL BLOTTER manufactured by Mitsui Petrochemical Industries, Ltd. When fine floating members (solid) are used as the air-isolating member 176, meshes, woven fabrics, unwoven fabrics, and the like may be used as the filter 180.

Since, in the present embodiment the filter 180 for cutting off the air-isolating member 176 is attached to one end of the pipe 198, even when the pump 200 continues its operation due to malfunction of the level sensor 180, the controller 182, or the like, and consequently the level of the replenisher 175 of the replenisher tank 174 drops below a predetermined minimum level, passage of the air-isolating member 176 is prevented by the filter 180 and the air-isolating member 176 is thus reliably prevented from flowing out from the replenisher tank 174 into the processing tank 20.

Preferably, the filter 180 is attached to the side of the replenisher tank 174 rather than to the side of the pump 200. In this case, it is preferred that a drain be attached to the replenisher tank 174 so as to remove the trapped air-isolating member 176.

What is claimed is:

1. A photosensitive material processing apparatus comprising:

a processing tank for processing a photosensitive material by immersing the photosensitive material in a processing solution contained therein;

a solution level regulation tank in which the solution surface of the processing solution is separated from the solution level of said processing tank; and a communication section through which the processing solution can communicate bi-directionally between said processing tank and said solution level regulation tank, wherein an air-isolating member is floated on the processing solution contained in said solution level regulation tank to thereby isolate the processing solution therein form outside air.

2. A photosensitive material processing apparatus according to claim 1, wherein said air-isolating member is a liquid having a specific gravity lower than that of the processing solution, or fine floating members.

3. A photosensitive material processing apparatus according to claim 2, wherein a filter is provided at said communication section so as to prevent passage of said air-isolating member.

4. A photosensitive material processing apparatus according to claim 2, wherein said communication section includes a reservoir section disposed between said solution level regulation tank and said processing tank, a first solution flow passage for connecting said solution level regulation tank and said reservoir section, and a second solution flow passage provided at a higher position than that of said first solution flow passage and used for connecting said reservoir section and said processing tank, wherein when the solution level of said processing tank drops below a certain level, the processing solution in said reservoir section is separated from that in said processing tank at said second solution flow passage to thereby prevent said air-isolating member contained in said solution level regulation tank from flowing into said reservoir section through said first solution flow passage.

5. A photosensitive material processing apparatus according to claim 1, wherein the surface area of the processing solution contained in said solution level regulation tank is greater than the surface area of the processing solution contained in the processing tank.

6. A photosensitive material processing apparatus according to claim 4, wherein the surface area of the processing solution contained in said solution level regulation tank is greater than that of the processing solution contained in the processing tank.

7. A photosensitive material processing apparatus according to claim 5, wherein said communication section has a ventilation portion which opens to outside air.

8. A photosensitive material processing apparatus according to claim 6, wherein said communication section has a ventilation portion which opens to outside air.

9. A photosensitive material processing apparatus comprising:

a processing tank for processing a photosensitive material through immersion of the photosensitive material in a processing solution contained therein;

a replenisher tank which contains a replenisher to be fed into said processing tank for replenishment and also contains air-isolating member floating on the replenisher so as to isolate the replenisher from outside air;

a transport mechanism for transporting the replenisher from said replenisher tank to said processing tank; and a prevention mechanism provided between said replenisher tank and said processing tank for preventing the entry of the air-isolating member into said processing tank.

10. A photosensitive material processing apparatus according to claim 9, wherein said prevention mechanism includes a reservoir section provided between said replenisher tank and said transport mechanism, a first solution flow passage for connecting said replenisher tank and said reservoir section, and a second solution flow passage, one end of which is connected to said reservoir section and the other end is connected to said transport mechanism, wherein when the solution level of said reservoir section drops to the bottom end of the opening of said second solution flow passage at the one end thereof, the air-isolating member in said replenisher tank does not flow into said reservoir section through said first solution flow passage.

11. A photosensitive material processing apparatus according to claim 9, wherein said prevention mechanism is a filter which allows passage of the replenisher, but does not allow passage of the air-isolating member.

12. A photosensitive material processing apparatus according to claim 9, wherein a replenisher charging section for feeding a replenisher into said replenisher tank is provided, and the replenisher outlet of said replenisher charging section is located lower than the lowest level of the bottom surface of the air-isolating member floating on the replenisher in said replenisher tank.

13. A photosensitive material processing apparatus according to claim 10, wherein a replenisher charging section for feeding a replenisher into said replenisher tank is provided, and the replenisher outlet of said replenisher charging section is located lower than the lowest level of the bottom surface of the air-isolating member floating on the replenisher in said replenisher tank.

14. A photosensitive material processing apparatus according to claim 11, wherein a replenisher charging section for feeding a replenisher into said replenisher tank is provided, and the replenisher outlet of said replenisher charging section is located lower than the lowest level of the bottom surface of the air-isolating member floating on the replenisher in said replenisher tank.

15. A photosensitive material processing apparatus according to claim 10, wherein said air-isolating member is a liquid having a lighter specific gravity than that of the processing solution, or fine floating members.

16. A photosensitive material processing apparatus according to claim 11, wherein said air-isolating member is a liquid having a lighter specific gravity than that of the processing solution, or fine floating members.

17. A photosensitive material processing apparatus according to claim 12, wherein said air-isolating member is a liquid having a lighter specific gravity than that of the processing solution, or fine floating members.

18. A photosensitive material processing apparatus according to claim 13, wherein said air-isolating member is a liquid having a lighter specific gravity than that of the processing solution, or fine floating members.

* * * * *